US006428224B1

(12) United States Patent
Askren et al.

(10) Patent No.: US 6,428,224 B1
(45) Date of Patent: Aug. 6, 2002

(54) ERROR MAPPING TECHNIQUE FOR A PRINTER

(75) Inventors: Benjamin Alan Askren, Lexington; Ronald Willard Baker, Versailles; James Richard Franks, Lexington; Michael Lewis Pawley, Nicholasville; Steven Andrew Rice, Shelbyville, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/468,140

(22) Filed: Dec. 21, 1999

(51) Int. Cl.[7] ..... B41J 11/42

(52) U.S. Cl. ..... 400/582; 400/583; 347/104; 347/105

(58) Field of Search ..... 347/104, 105; 400/582, 583, 583.1, 583.2, 583.3, 583.4

(56) References Cited

U.S. PATENT DOCUMENTS

| | | | | |
|---|---|---|---|---|
| 4,062,648 | A | 12/1977 | Hennessee | 364/105 |
| 4,118,129 | A | 10/1978 | Grundherr | 400/144.2 |
| 4,413,275 | A | 11/1983 | Horiuchi et al. | 358/75 |
| 4,459,675 | A | 7/1984 | Bateson et al. | 364/519 |
| 4,463,435 | A | 7/1984 | Cavill | 364/519 |
| 4,591,969 | A | 5/1986 | Bloom et al. | 364/183 |
| 4,761,662 | A | 8/1988 | Yoshimoto et al. | 364/108 |
| 4,800,396 | A | 1/1989 | Hertz | 346/1.1 |
| 4,878,063 | A | 10/1989 | Katerberg | 364/1.1 |
| 4,968,882 | A | 11/1990 | Tzeng et al. | 250/231.14 |
| 5,070,410 | A | 12/1991 | Hadley | 358/296 |
| 5,209,589 | A | 5/1993 | Bliss | 400/568 |
| 5,233,920 | A | 8/1993 | Shinmoto et al. | 101/248 |
| 5,241,525 | A | 8/1993 | Taylor | 369/70 |
| 5,297,871 | A | 3/1994 | Fujioka | 400/568 |
| 5,301,608 | A | 4/1994 | Szarka et al. | 101/129 |
| 5,448,269 | A | 9/1995 | Beauchamp et al. | 347/19 |
| 5,451,990 | A | 9/1995 | Sorenson et al. | 347/37 |
| 5,461,484 | A | 10/1995 | Orlicki et al. | 358/296 |
| 5,462,371 | A | 10/1995 | Beretta et al. | 400/569 |
| 5,482,390 | A | 1/1996 | Murakami et al. | 400/636.2 |
| 5,493,385 | A | 2/1996 | Ng | 355/326 R |
| 5,505,550 | A | 4/1996 | Kitahara et al. | 400/618 |
| 5,598,201 | A | 1/1997 | Stodder et al. | 347/104 |
| 5,600,350 | A | 2/1997 | Cobbs et al. | 347/19 |
| 5,618,120 | A | 4/1997 | Ishikawa | 400/708 |
| 5,644,344 | A | 7/1997 | Haselby | 347/19 |
| 5,719,602 | A | 2/1998 | Hackleman et al. | 347/14 |
| 5,751,303 | A * | 5/1998 | Erickson et al. | 347/104 X |
| 5,779,378 | A | 7/1998 | Kikuchi | 400/616.2 |
| 5,825,378 | A | 10/1998 | Beauchamp | 347/19 |
| 5,847,722 | A | 12/1998 | Hackleman | 347/19 |
| 6,137,592 | A * | 10/2000 | Arquilevich et al. | 358/1.8 |

* cited by examiner

*Primary Examiner*—Andrew H. Hirshfeld
*Assistant Examiner*—Minh H. Chau
(74) *Attorney, Agent, or Firm*—Dinsmore & Shohl

(57) ABSTRACT

The present invention relates to a method and system for accurately indexing print receiving media of various types. A media indexing system is provided that includes a roller capable of indexing a print receiving medium in response to an indexing operation. A relationship exists between a commanded indexing operation of the roller and resultant indexing of a first type of print receiving medium. A type of print receiving medium is supplied to the media indexing system. The type of the print receiving medium is generally identified. A desired amount by which the print receiving medium should be indexed is identified. A commanded indexing operation of the roller to index by the desired amount is modified based on the type of the print receiving medium and the relationship. The print receiving can be indexed by substantially the desired amount.

21 Claims, 9 Drawing Sheets

ERROR MAPPING TECHNIQUE FOR A PRINTER

TECHNICAL FIELD

The present invention relates to printers, and, more specifically, to a method and system for accurately indexing print receiving media of various types in a printer.

BACKGROUND OF THE INVENTION

Conventional printers can typically be classified as either electrophotographic printers or ink jet printers. Ink jet printers, for example, typically include recording heads, referred to hereinafter as printheads, which employ transducers that utilize kinetic energy to eject ink droplets. A thermal printhead, for example, rapidly heats thin film resistors (or heaters) to boil ink, thereby ejecting an ink droplet onto a print receiving medium, such as paper. According to this ink jet method, upon firing a resistor, a current is passed through the resistor to rapidly generate heat. The heat generated by the resistor rapidly boils or nucleates a layer of ink in contact with or in proximity to a surface of the resistor.

The nucleation causes a rapid vaporization of the ink vehicle, creating a vapor bubble in the layer of ink. The expanding vapor bubble pushes a portion of the remaining ink through an aperture or orifice in a plate, so as to deposit one or more drops of the ink on a print receiving medium, such as a sheet of paper. According to one embodiment of an ink jet printer, by moving the printhead relative to the print receiving medium, a swath of ink drops can be provided on the print receiving medium to form an image, or part of an image, thereon.

Typically, in the aforementioned embodiment, the print receiving medium is kept stationary while the printhead traverses and deposits ink drops. In such an embodiment, when the printhead reverses directions, the print receiving medium is indexed (e.g., advanced forward) in preparation for the next printhead traverse. Thus, a plurality of print swaths can be utilized to create images that are larger in dimension than a single print swath.

As can be understood, properly positioning the print receiving medium relative to the printhead for each print swath can be a critical factor. For example, indexing the medium too far might result in a gap or "white" band (assuming the print receiving is white) between print swaths, while indexing the medium too little might result in overlapping swaths that could create dark horizontal bands in the resulting image. When printing graphic objects or photographic-like images, where even very subtle hue shifts can be detectable by an observer, such swath misplacements can be particularly noticeable, and therefore negatively affect the resultant print quality.

Swath misplacements can be attributed to a variety of factors, such as indexing errors, for example. In particular, indexing errors are believed to occur as a result of the cumulative effect of tolerances associated with parts in the indexing system, which tend to prevent a perfect linear relationship between operation of the indexing system (e.g., rotation of the feed roller) and resultant indexing of the print receiving medium. For example, in one embodiment of a media indexing system including a feed roller and a drive motor, motor positioning errors, gear eccentricities and tooth-to-tooth errors, bearing clearances, media slippage in the feed roller nip, and the eccentric mounting and diameter variation of the feed roller can contribute to indexing errors. Although one approach to reducing indexing errors can be to tighten the tolerances of the various components to reduce their residual error, such an approach can lead to an indexing system that uses components which are prohibitively expensive and/or require unreasonable manufacturing procedures.

Conventionally, printers have dealt with indexing errors by utilizing multi-pass printing, hereinafter referred to as shingling. For example, in one form of ink jet printer shingling, a fraction of the total number of ink drops are deposited during each of a plurality of passes, while the print receiving medium is indexed by a corresponding fraction of the printhead height. However, as can be understood, shingling can reduce system throughput because of the additional printhead traverses.

Another conventional approach to solving problems associated with indexing errors has been to use a DC servomotor to drive a feed roller, for example, and to mount a rotary encoder disc directly on the shaft of the feed roller. In this approach, an encoder sensor can provide feedback information to a closed-loop control system that can control the angular position of the feed roller for each indexing operation. However, this approach does not appear to compensate for errors caused by components between, for example, the encoder disc and the print receiving medium, such as, for example, runout errors associated with an eccentric mounting of the encoder disc, errors associated with an eccentric mounting and diameter variation of the feed roller, bearing clearances, and media slippage. "Runout" is defined as movement of a cylindrical surface of an object in the radial direction, relative to the surfaces that support the object, during one rotation of the object.

An additional approach is purportedly disclosed in U.S. Pat. No. 5,825,378 (hereinafter referred to as "the '378 patent"), entitled "Calibration of Media Advancement to Avoid Banding in a Swath Printer." The '378 patent appears to relate to a calibration technique for determining media advance calibration in a swath printer that includes drawing a series of lines on media that correspond to an angle of rotation of the platen, and then using an optical sensor to read the actual positions of the lines in order to transmit a correction signal. However, the system disclosed in the '378 patent appears to require an independent calibration for each type of print receiving media used therewith. As disclosed in U.S. Pat. No. 5,598,201 (hereinafter referred to as "the '201 patent"), entitled Dual-Resolution Encoding System for High Cyclic Accuracy of Print-Medium Advance in an Inkjet Printer," the system apparently disclosed as the preferred embodiment of the '378 patent also appears to be awkward to use. Therefore, it would be advantageous to have a method and system for accurately indexing print receiving media in a printer that is also relatively simple to use.

SUMMARY OF THE INVENTION

Accordingly, it is an object of the present invention to improve the accuracy of indexing print receiving media in a printer.

It is another object of the present invention to provide a method and system for accurately indexing print receiving media of various types in a printer.

According to one embodiment of the present invention, a method for accurately indexing print receiving media of various types is provided. A media indexing system is provided that includes a roller capable of indexing a print receiving medium in response to an indexing operation. A relationship exists between a commanded indexing operation of the roller and resultant indexing of a first type of print receiving medium. A type of print receiving medium is supplied to the media indexing system. The type of the print receiving medium is generally identified. A desired amount by which the print receiving medium should be indexed is identified. A commanded indexing operation of the roller to index by the desired amount is modified based on the type of the print receiving medium and the relationship, wherein the print receiving is indexed by substantially the desired amount.

In a preferred embodiment, the commanded indexing operation of the roller is scaled based on the type of the print receiving medium. More preferably, the commanded indexing operation is scaled based on a proportionality of an effective circumference of the roller when indexing a print receiving medium of the first type to an effective circumference of the roller when indexing a print receiving medium of the type being indexed. In yet another preferred embodiment, the desired amount by which the print receiving medium should be indexed is scaled based on the type off the print receiving medium and an error map, based on the relationship, is applied to the scaled desired amount.

In another embodiment of the present invention, a system for accurately indexing print receiving media of various types is provided. The system includes a media indexing system, a sensor, and a control module. The media indexing system includes a roller capable of indexing a print receiving medium in response to an indexing operation. A relationship exists between a commanded indexing operation of the roller and resultant indexing of a first type of print receiving medium. The sensor is capable of generally identifying a type of print receiving medium supplied to the media indexing system. The control module is capable of identifying a desired amount by which the print receiving medium should be indexed and modifying a commanded indexing operation of the roller to index by the desired amount, based on the type of the print receiving medium and the relationship, wherein the print receiving is indexed by substantially the desired amount.

Still another embodiment of the present invention relates to a system for accurately indexing print receiving media of various types. The system includes a media indexing system including a roller capable of indexing a print receiving medium in response to an indexing operation. A relationship exists between a commanded indexing operation of the roller and resultant indexing of a first type of print receiving medium. A means for generally identifying a type of print receiving medium supplied to the media indexing system is provided. A means for identifying a desired amount by which the print receiving medium should be indexed is also provided. Furthermore, a means for modifying a commanded indexing operation of the roller to index by the desired amount, based on the type of the print receiving medium and the relationship is provided, wherein the print receiving is indexed by substantially the desired amount.

Still other aspects of the present invention will become apparent to those skilled in this art from the following description, wherein there is shown and described, simply by way of illustration, various embodiments of this invention, simply by way of illustration. As will be realized, the invention is capable of other different aspects and embodiments without departing from the scope of the invention. Accordingly, the drawings and descriptions should be regarded as illustrative in nature and not as restrictive in nature.

BRIEF DESCRIPTION OF THE DRAWINGS

While the specification concludes with claims particularly pointing out and distinctly claiming the invention, it is believed the same will be better understood from the following description taken in connection with the accompanying drawings in which:

DETAILED DESCRIPTION OF THE PREFERRED EMBODIMENTS.

Figure 1:
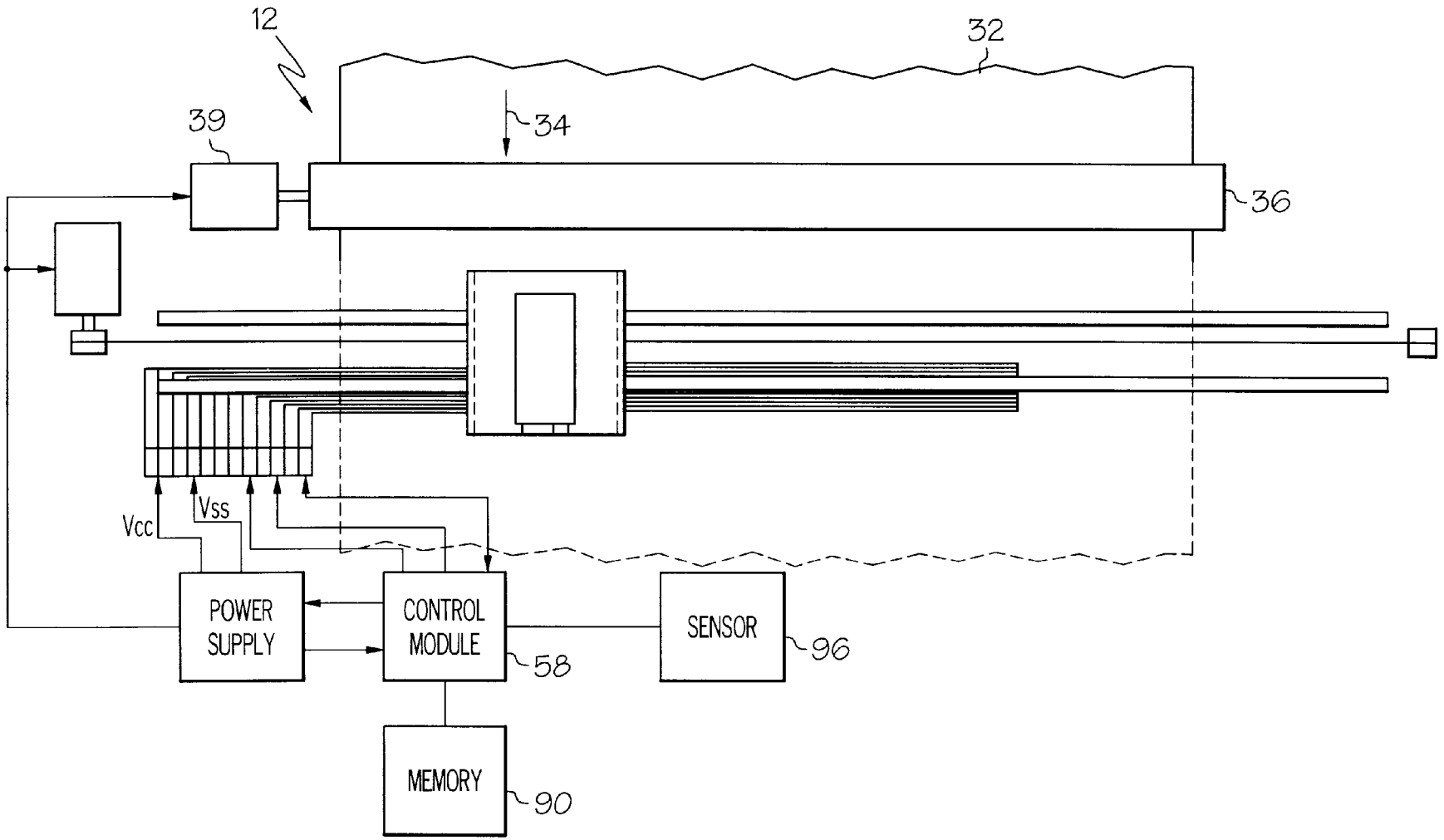
FIG. 1 is a schematic plan view of a thermal ink jet printer that can utilize an embodiment of the present invention.

Referring now to the drawings in detail, wherein like numerals indicate the same elements throughout the views; FIG. 1 illustrates an embodiment of a system, such as printer 30, to which the present invention can be applicable. A print receiving medium 32, which can be a recording medium made from paper, thin film plastic or the like, can be indexed, such as by being advanced in the direction of an arrow 34, under the control of a media indexing system 12, such as one comprising a drive or feed roller 36 having a nominal circumference, for example. According to this embodiment of the present invention, and as can be understood by one of ordinary skill in the art, the feed roller 36 is capable of indexing the print receiving medium 32 in response to a commanded indexing operation, such as one applied by machine electronics, such as control module 58, to a drive motor 39 with a shaft coupled to feed roller 36.

Figure 2:
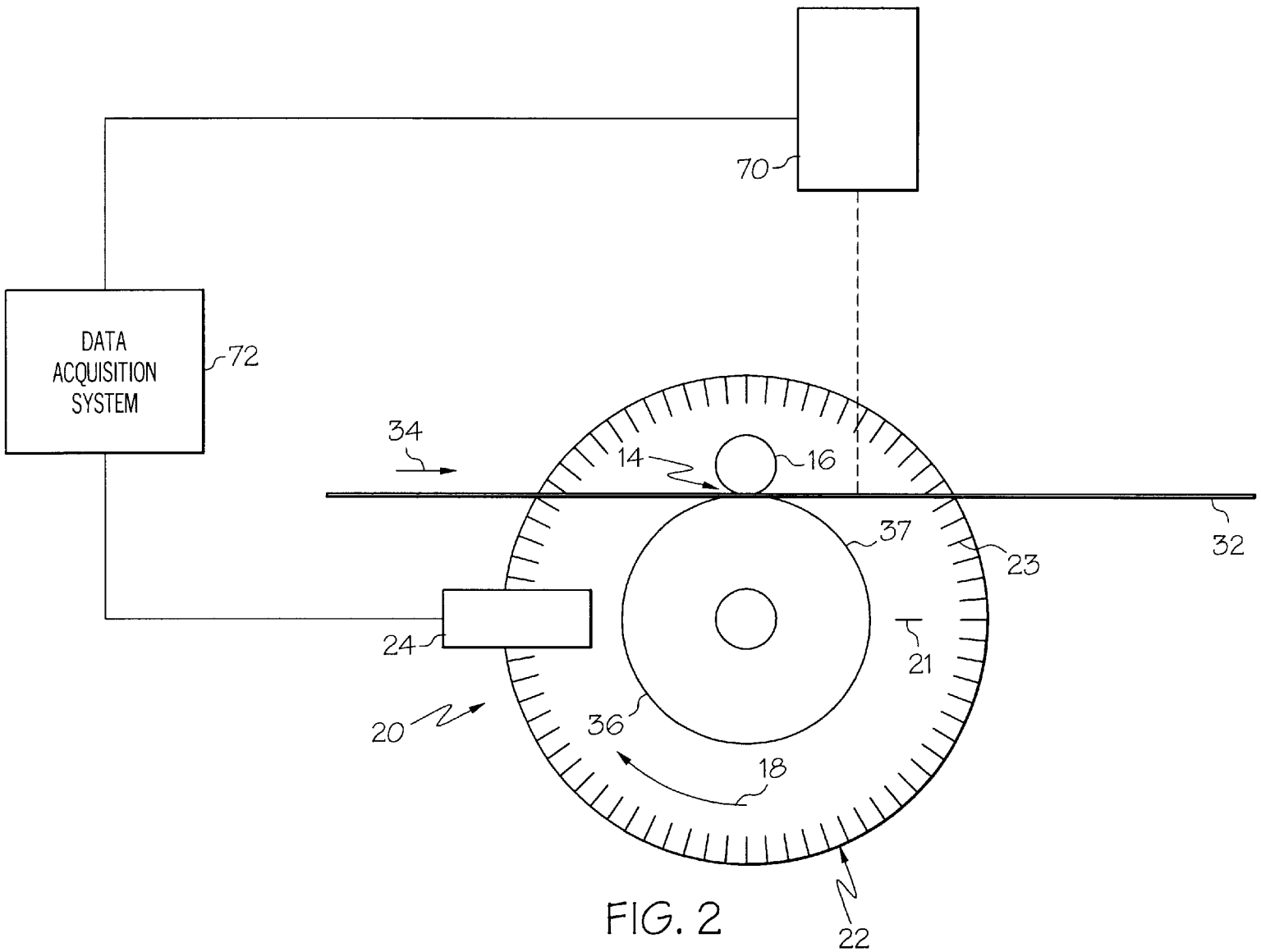
FIG. 2 is a schematic plan view of a media indexing system according to a preferred embodiment of the present invention.

For example, as depicted in FIG. 2, the print receiving medium 32 can be fed into a nip 14 between feed roller 36 and backup roller 16. According to this exemplary embodiment, the print receiving medium 32 can be placed in contact with the feed roller 36 by the backup roller 16, which can allow the medium to be driven by an outer surface 37 of the feed roller. Preferably, the print receiving medium 32 is held in pressure contact with the feed roller 36 by a series of backup rollers that are biased (e.g., spring-loaded) against the feed roller.

Although the feed roller 36 can be formed from a variety of materials, such as a rubber-coated or thermal spray-coated (e.g., aluminum oxide or tungsten carbide) steel shaft, for example, it preferably comprises a thermal spray-coated and hollow steel tube. The stiffness of such a preferred feed roller 36 can allow for a significantly higher backup roller force with less deflection than what could be used with a solid shaft of equivalent weight. One advantage of utilizing a higher backup roller force can include, for example, helping to prevent slippage of the print receiving medium 32 during an indexing operation. Another advantage of the preferred feed roller 36 can include, for example, its high strength to weight ratio can allow for a large feed roller outside diameter, which can be used to increase the wrap angle of the print receiving medium 32 around the feed roller, thereby helping to reduce slippage while avoiding potentially permanent media deformation, such as curling.

In a preferred embodiment of the present invention, feed roller 36 is essentially seamless, concentric and of close tolerance. For example, the drive roller 36 can be formed from carbon steel tubing, manufactured with the drawn over mandrel process, that is centerless ground to the desired dimensions and electroless nickel plated. Tungsten carbide is preferably thermal spray coated on the feed roller 36, providing the feed roller 36 with a surface roughness targeted at about 300 ⊨inRa and a coating thickness of about 0.076±0.013 mm. One advantage of thermal spray processes can be that substantially no runout error is added to the feed roller 36. Adding runout error can, for example, cause the effective radius of feed roller 36 to change, thereby altering the distance that print receiving medium 32 moves for a given angular rotation of the feed roller.

According to an embodiment of the present invention involving a feed roller, such as feed roller 36, the feed roller is preferably driven by a motor, such as the drive motor 39, via control logic, which can be applied through control module 58, for example. Drive motor 39 preferably comprises either a DC servomotor or a stepper motor. Although drive motor 39 can be directly coupled to the feed roller 36, it is preferably coupled via a gear train (not shown).

When the indexing system 12 is operated, such as by operating feed roller 36 in response to an indexing operation from the control module 58, the print receiving medium 32 can be indexed. For example, in the illustrative embodiment discussed herein, if the tolerances of each of the involved components were perfect, indexing the feed roller 36 in the direction indicated by arrow 18 should result in indexing the print receiving medium by a linearly corresponding amount in the direction of arrow 34. However, as previously stated, apparently because of the cumulative effect of tolerances associated with components in the indexing system, a perfect linear relationship between operation of the indexing system (e.g., rotation of the feed roller) and resultant indexing of the print receiving medium 32 tends not to exist.

According to one embodiment of the present invention, steps are taken in an effort to determine the relationship between operation of the indexing system (e.g., rotation of the feed roller) and resultant indexing of the print receiving medium 32. For example, in an indexing system where the errors are generally cyclical (e.g., repeatable over one complete revolution of the feed roller 36), a relationship between the operation of the indexing system (e.g., rotating the feed roller) and the resultant indexing of the print receiving medium (e.g., media displacement) can be empirically determined, such as by error mapping the system. In a preferred embodiment of the present invention, such a relationship is sought between angular positioning of the feed roller 36 and a resulting indexing of the print receiving medium 32.

According to the current example, the relationship is determined by identifying the difference between a change in the angular position of the feed roller 36 and a resultant change in the index location of the print receiving medium 32 for a number of angular positions on the feed roller. Preferably, an encoder, such as rotary encoder 20, for example, is coupled to the feed roller 36 to track the angular position of the feed roller. Rotary encoder 20 can comprise a measuring standard, such as a rotary encoder disc 22, and a sensor, such as encoder sensor 24.

Although the encoder can be either an analog or digital encoder, it is preferably an analog encoder. The encoder disc 22 can have a series or track of encoder lines 23 regularly spaced around its circumference, with the spacing between adjacent ones of the encoder lines 23 defining a window. Preferably, the encoder disc 22 has about 2400 encoder lines 23, with each line preferably having a circumferential line spacing of about 200 lines per inch. The encoder disc is also preferably large with respect to feed roller 36, thereby allowing for an increase in the angular position resolution.

Preferably, the encoder disc 22 also has an additional track comprising a single encoder line, such as index mark 21, for example. The index mark 21 can be utilized to define a home position of the feed roller 36 and encoder disc 22 when indexing print receiving media. For example, the index mark 21 can trigger the index sensor 24 when the mark passes by the sensor. Thus, the index mark 21 can be used to determine the absolute angular position of the feed roller 36 once per revolution of the feed roller, which can be used to trigger the acquisition of data for creating an error map of the media indexing system 12.

A preferred encoder sensor 24 comprises three channels, where two of the channels are utilized in reading the series of encoder lines 23 (e.g., in both directions) and one of the channels is utilized for reading the index mark 21. Preferably, the media indexing system 12 utilizes the readings of the encoder lines 23 to count the angular position of the encoder disc 22 in quadrature, as can be understood by one of ordinary skill in the art. Thus, angular position can be determined within four times the number of lines per one revolution of the encoder disc 22.

In a preferred embodiment, the quadrature count can be further subdivided by interpolating along the slope of the waveform produced by the encoder sensor 24. Therefore, the media indexing system 12 according to such an embodiment can determine angular position of the encoder disc 22 to a resolution of about 0.001 lines (0.00015 degrees). Preferably, the computations related to determining the angular position of the encoder disc 22, and thus an approximation of the angular position of the feed roller 36, are performed by control module 58, such as an engine card, for example.

Figure 3:
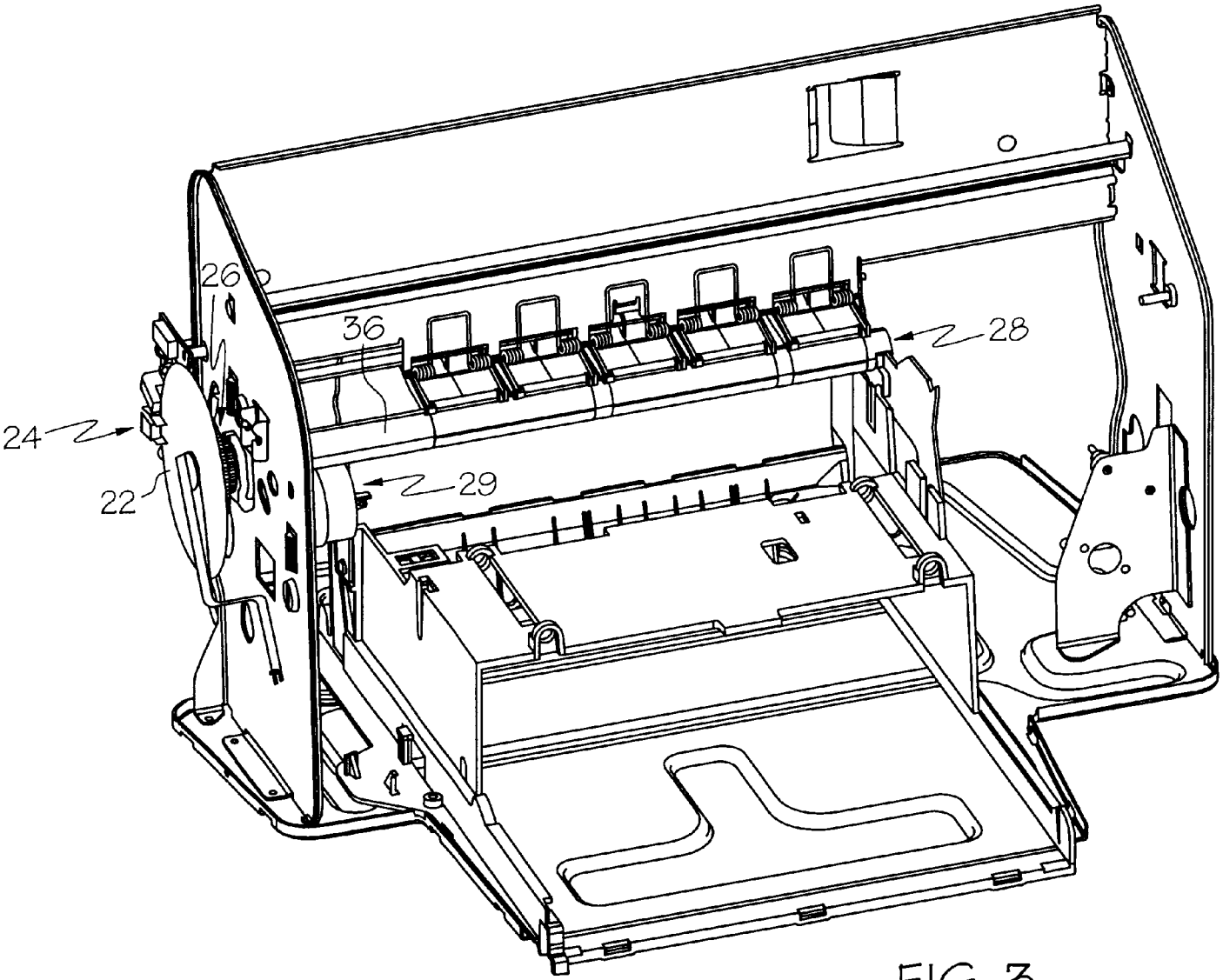
FIG. 3 is a perspective view of a printer that utilizes the media indexing system shown in FIG. 2.

In a preferred embodiment, the rotary encoder 20 is directly mounted to the outside diameter of the feed roller 36, such as by a precise slip fit, for example. One advantage of such a mounting can be that it reduces inaccuracies between graphics on the encoder disc 22 and the outside diameter of the feed roller 36. Similarly, in embodiments utilizing a gear train, such as that shown in FIG. 3, the feed roll gear 26 is also preferably mounted to the outside diameter of the feed roller 36. Furthermore, when the feed roller 36 is supported in the media indexing system 12 by bearings 28, the bearing surfaces are also preferably located on the outside diameter of the feed roller. One advantage of mounting all of the related components, such as the feed roll gear 26, encoder disc 22, thermal spray coating, and bearings 28, for example, to a single surface of the feed roller 36 can be that such an embodiment can minimize the effects of component tolerances.

Figure 4:
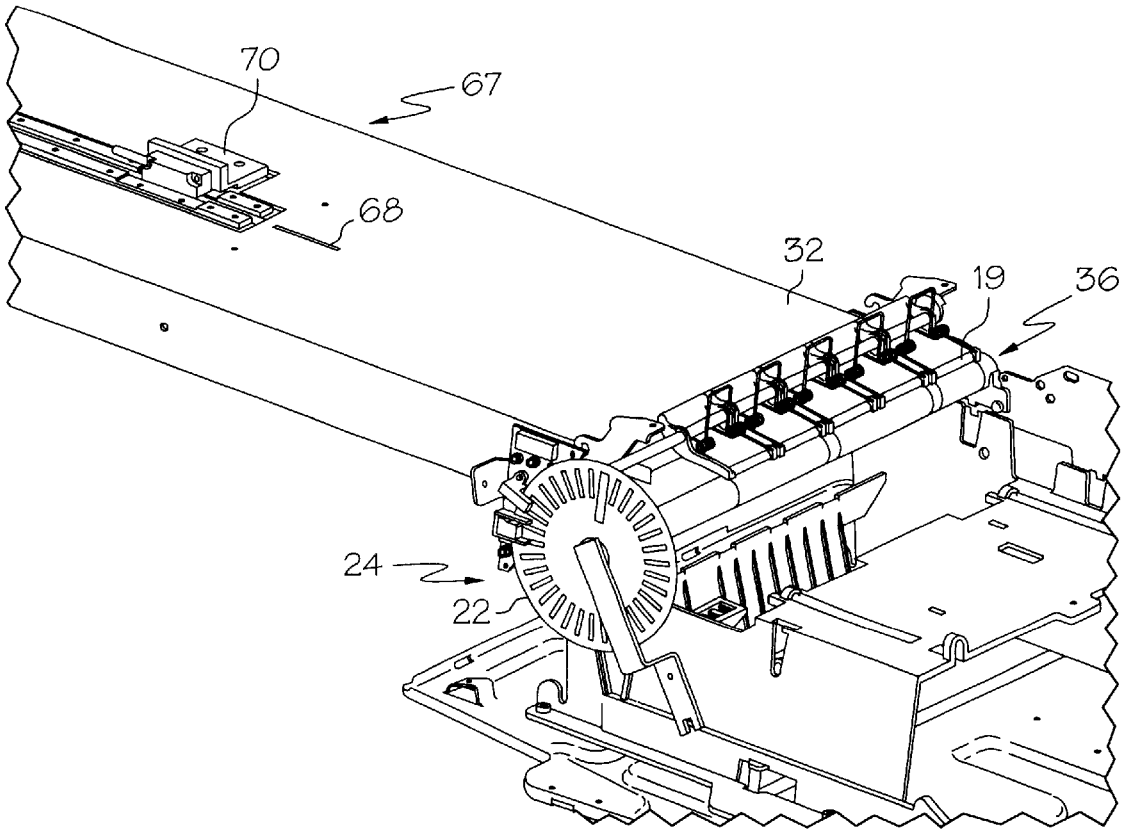
FIG. 4 is a perspective view of a media indexing system and media measuring device according to one embodiment of the present invention.

Meanwhile, referring to FIG. 4, the indexing position of print receiving medium 32 can also be determined through the use of an encoder, such as linear encoder 67. For example, a measuring standard, such as a steel encoder strip 68, for example, can be coupled to the print receiving medium 32, such as by attaching the strip directly to the medium. Preferably, the encoder strip 68 comprises a plurality of lines spaced at about 20 $\mu$m. An encoder sensor 70, which is preferably separate from the media indexing system 12, can be used to read the position of the linear encoder strip while the print receiving medium 32 is being fed through the media indexing system 12. Preferably, the linear encoder strip 68 is attached to the trailing edge of the print receiving medium 32.

Figure 5:
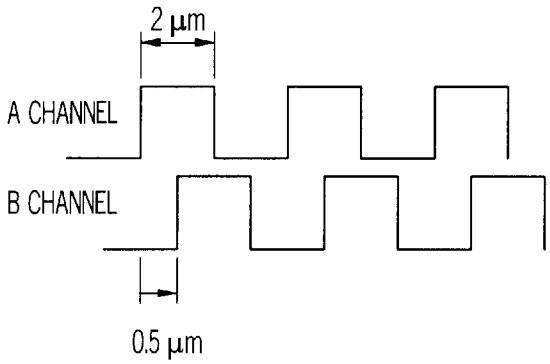
FIG. 5 is a graphical representation of encoder channels according to one embodiment of the present invention.

Preferably, an encoder sensor 70 with a digital output of about 10× interpolation is utilized with such an embodiment of the present invention. In a 2-channel system with the 10× interpolation, the preferred linear encoder can have a period spacing of about 2 $\mu$m. By counting in quadrature, the position of linear strip 68 can be determined within ±0.5 $\mu$m, as shown in FIG. 5. Although an embodiment featuring a linear encoder strip traveling with, or as part of, print receiving medium 32 has been disclosed herein as an example, any media measuring device capable of accurately measuring, for example, the displacement and/or velocity of a test media moving through nip 14 as feed roller 36 turns, can be utilized with the illustrative embodiment of the present invention, as discussed herein. For example, the media measuring device can also comprise an optical motion sensing device, a vision system which tracks the motion of a target on the media, or other suitable device.

In one embodiment of the present invention, the media indexing system 12 can be error mapped by attaching the encoder strip 68 to a print receiving medium 32, such as a piece of 20 pound paper, and feeding the print receiving medium 32 through the media indexing system, as shown in FIG. 4. For example, an operator can load the print receiving medium 32 into the nip 14 of media indexing system 12, and the encoder strip 68 can be attached to the trailing edge of the print receiving medium 32, such as with a piece of tape for example. Control module 58 can, for example, command the media indexing system 12 to rotate feed roller 36 at a constant velocity.

Once the index mark 21 passes the index sensor 24, a data acquisition system 72, which is preferably physically separate from media indexing system 12, can begin counting the number of linear encoder pulses during each window of the rotary encoder disk 22. From this data, an error map can be determined. Thus, according to a preferred embodiment of the present invention, the feed roller 36. Moves the print receiving medium 32, either incrementally or continuously, while angular position or velocity data is collected by the encoder sensor 24, and media position or velocity data is collected by the media measuring device, such as encoder sensor 70.

The media measuring device, such as encoder sensor 70, is preferably physically separate from the media indexing system 12. For example, the media measuring device can be part of a separate fixture (not shown). Accordingly, the media indexing system 12 can be placed in the fixture including the media measuring device. Thus, the error map of the media indexing system 12 can be determined in the fixture, and stored with the media indexing system 12, such as with the control module 58. The media indexing system 12 can then be removed from the fixture.

In a preferred embodiment, where data used for error mapping is acquired using data acquisition system 72, the data acquisition system can comprise a data acquisition computer running, for example, LABVIEW™, which is available from National Instruments Corporation, Austin, Tex. Preferably, after the print receiving medium 32 is loaded, the control module 58 commands the feed roller 36 to rotate at a constant nominal speed, such as about 3.2 revolutions per second. As previously mentioned, a sheet of 20 pound legal-sized (8.5×14 inch) paper can be utilized as the print receiving medium 32.

Figure 6:
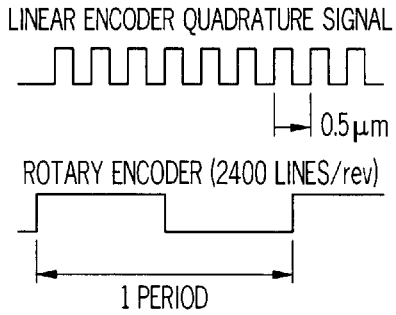
FIG. 6 is a graphical representation of data acquisition as utilized in one embodiment of the present invention.

In one embodiment of the present invention, the repeatability of the relationship is determined. For example, in a preferred embodiment, data is acquired over multiple revolutions (e.g., four) of the feed roller 36. One advantage of utilizing multiple revolutions can be that the additional data might help determine the repeatability of a determined relationship. For example, once index mark 21 passes index sensor 24, software associated with data acquisition system 72 can use a squared digital form of the rotary encoder signal as a clock, and can count the number of quadrature counts (e.g., 0.5 $\mu$m steps) of the linear strip 68 that occur during one period of the encoder disc 22, as shown in FIG. 6. The acquired data can then be manipulated so that a relationship between rotation of feed roller 36 and displacement of print receiving medium 32 can be determined.

As described in the following illustrative embodiment, which represents a preferred embodiment of the present invention, the data can be manipulated so that a relationship between rotation of feed roller 36 and media displacement can be determined. For example, in a preferred embodiment of the present invention, the data is manipulated so that noise from the relationship can be filtered and the repeatability of the relationship can be determined. An illustrative example of manipulation of the data according to a preferred embodiment is detailed below.

Figure 7:
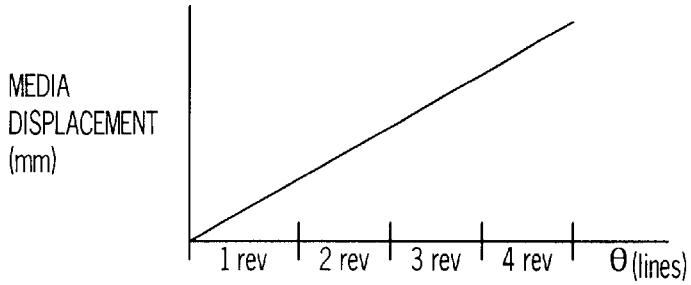
FIG. 7 is a graphical representation of an exemplary cumulative data count as utilized by a preferred embodiment of the present invention.
Figure 8:
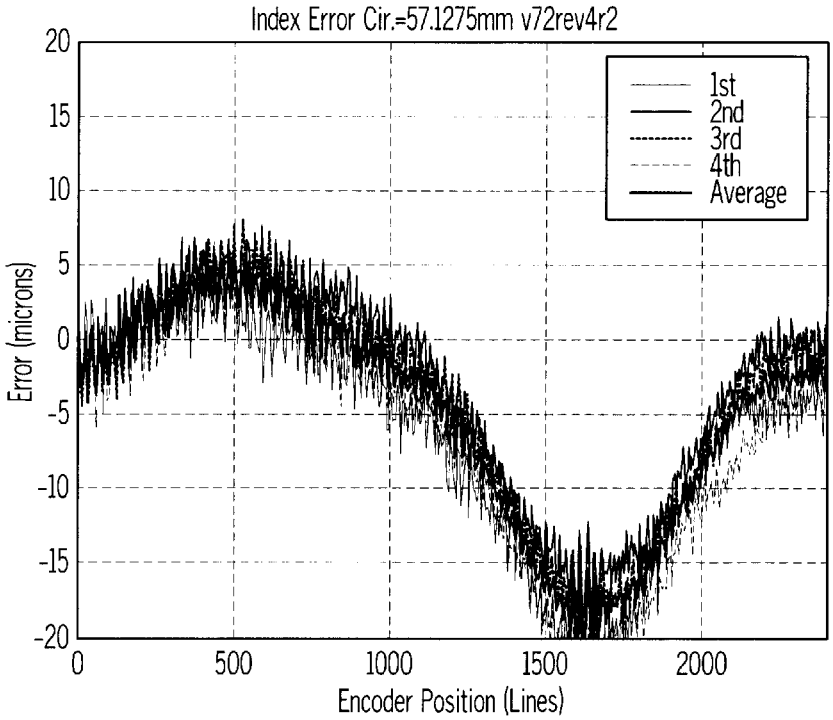
FIG. 8 is a graphical representation of an error curve without filtering.
Figure 9:
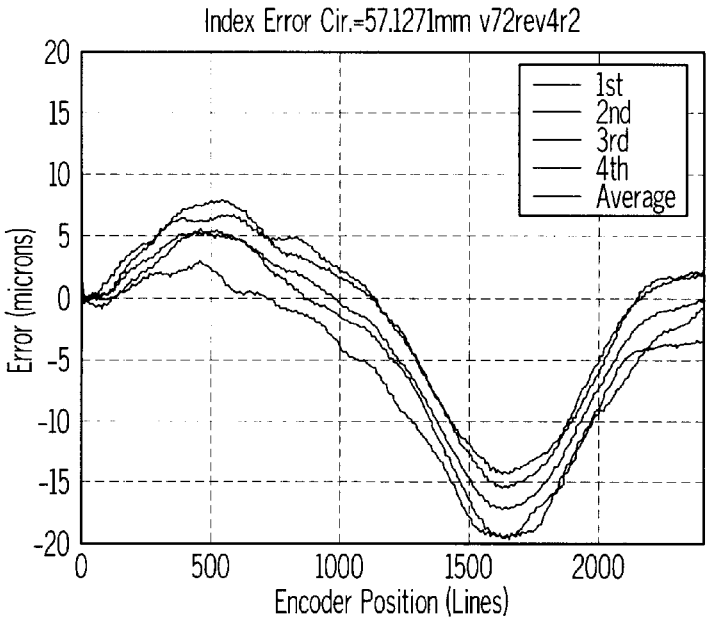
FIG. 9 is a graphical representation of an error curve with filtering according to a preferred embodiment of the present invention.

For example, according to one embodiment of the present invention, incremental data acquired by data acquisition system 72 for each revolution is preferably converted to a cumulative count of rotary encoder position, θ (lines), versus media displacement (millimeters), as shown by example in FIG. 7. Preferably, 100-point averaging is performed on the cumulative count. As understood by one of ordinary skill in the art, 100-point averaging comprises utilizing a moving average of 50 points before and 50 points after an $i_{th}$ point. One advantage of performing 100-point averaging can be to help filter signal noise which may be on top of the true data representing the relationship. For example, an advantage of 100-point averaging the data can be seen by comparing FIGS. 8 and 9.

The relationship is preferably mapped, such as in an error map. For example, the difference between angular position of feed roller 36 and index location of print receiving medium 32, for a discrete number of angular positions on the feed roller, can be mapped. Preferably, an error map for the media indexing system 12 is created by, for example, separating data by the revolution during which it was acquired, reducing the deviation between the revolutions, compressing the relationship, and then storing the relationship.

As previously discussed, feed roller 36 is preferably revolved multiple times during data acquisition. In a preferred embodiment, feed roller 36 is revolved four times, allowing four independent measurements of the feed roller rotation/media displacement relationship to be taken. Thus, by acquiring data over multiple revolutions of feed roller 36, the repeatability of the relationship can be determined.

Figure 10:
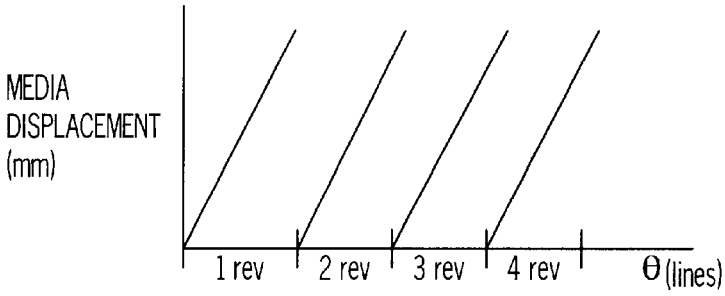
FIG. 10 is a graphical representation of exemplary feed roller revolutions.

In one embodiment, the data can be separated by the revolution during which it was acquired. For example, the cumulative count, such as that shown by example in FIG. 7, is preferably converted into cumulative counts for each revolution of feed roller 36, as shown in FIG. 10, where the last number in each of the cumulative counts for each revolution is believed to represent the effective feed roller circumference as seen by print receiving medium 32. The cumulative counts for each revolution can be placed in a displacement matrix, S, as shown below in Equation 1.

$$S(i,\ j) = \begin{pmatrix} 0 & \ldots & Circumference1 \\ 0 & \ldots & Circumference2 \\ 0 & \ldots & Circumference3 \\ 0 & \ldots & Circumference4 \end{pmatrix} \qquad \text{Equation (1)}$$

$$j=\theta+1 \qquad \text{Equation (2)}$$

Where, n=number of revolutions (e.g., 4)

m=points in error map (e.g., 2401)

$0 \leqq \theta \leqq 2400$

The displacement matrix, S, is preferably an $n_x m$ matrix, where n is the number of rows and m is the number of columns. Each row preferably represents a single revolution cumulative count of media displacement. Therefore, in a preferred embodiment, i corresponds to one of the revolutions of feed roller 36 and j corresponds to the angular position of the feed roller (relative to the home position).

The average of these revolutions is preferably used as the error map. One advantage of using the average can be that such an approach can help reduce the affect of deviations inherent in each revolution. For example, the data over the revolutions can be averaged and placed in the displacement matrix S as a new vector. The new vector, s, can form the error map, and is believed to define the average effective feed roller circumference as seen by print receiving medium 32.

$$S(i,\ j) = \begin{pmatrix} 0 & \ldots & Circumference1 \\ 0 & \ldots & Circumference2 \\ 0 & \ldots & Circumference3 \\ 0 & \ldots & Circumference4 \\ 0 & \ldots & CircumferenceAverage \end{pmatrix} \qquad \text{Equation (3)}$$

Where, $1 \leqq i \leqq 5$ $1 \leqq j \leqq 2401$ $$s(j) = \begin{pmatrix} 0 \\ \vdots \\ CircumferenceAverage \end{pmatrix} \qquad \text{Equation (4)}$$

Preferably, the relationship, such as the error map s, for example, is compressed for use by the media indexing system 12. For example, the error maps can be rebuilt by the media indexing system 12 if the error map, s, can be separated into two components. The first component can be represented by a line with a slope defined by the effective circumference of feed roller 36 as seen by print receiving medium 32. The second component can be represented by the variation of the error map from the line described above during one revolution of feed roller 36. These two components are analogous to the electrical circuitry concepts of direct current (DC) and alternative current (AC), respectively, and will henceforth be described using this terminology.

For example, the AC component can be determined by identifying the variation of each individual revolution in the displacement matrix S from a line defined by the average effective circumference of feed roller 36. The AC component can then be placed in an error matrix, where the last row of the matrix defines an error vector corresponding to the variation of the error map about the line defined by the average effective circumference of feed roller 36. For example, errors, such as those between feed roller 36 and encoder disc 22 in a preferred embodiment of the present invention, can be shown by an error matrix, E, as depicted in Equation 5.

$$E(rev\#,\ \theta) = \left(S(rev\#,\ \theta+1) - \frac{CircumferenceAverage}{2400} \cdot 1000\ \frac{\mu m}{mm}\right.$$

Where, $$i=rev\# \qquad \text{Equation (5)}$$

$$j=\theta+1$$

$$E(i,\ j) = \left(S(i,\ j) - \frac{S(5,2401) - S(5,1)}{2400} \cdot (j-1)\right) \cdot 1000\ \frac{\mu m}{mm}$$

In a preferred embodiment of the present invention, error matrix E shows the variation of each individual data revolution from a line defined by the average effective circumference of feed roller 36. The error vector, e (e.g., the fifth row of the error matrix in the present illustrative embodiment), as detailed in Equation 6, can show the error map's oscillation (e.g., in microns) about the line defined by the average effective circumference of feed roller 36.

$$E(j) = \left(s(j) - \frac{s(2401) - s(1)}{2400} \cdot (j-1)\right) \cdot 1000\ \frac{\mu m}{mm} \qquad \text{Equation (6)}$$

Figure 11:
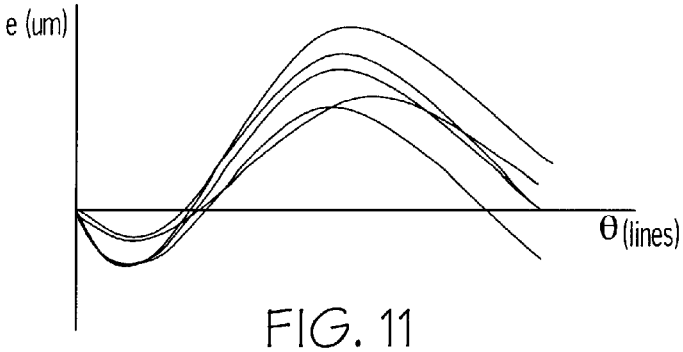
FIG. 11 is a graphical representation of index error as seen in an exemplary embodiment of the present invention.

FIG. 11 illustrates, by example, typical error for a media indexing system, such as media indexing system 12 comprising feed roller 36. Curve 80 represents the error vector (or error curve) of the error map. Meanwhile, curves 81, 82, 83, and 84, represent the error of individual revolutions from a line defined by the average effective circumference of feed roller 36. Thus, in the current illustrative example of a preferred embodiment of the present invention, the error vector e represents the AC component of the error map s.

Preferably, the size of data used to implement the relationship should be minimized. For example, the AC component can be converted into a discrete incremental count (e.g., with ¼ $\mu$m resolution). According to a preferred embodiment of the present invention, the AC component, e, is rounded to the closest ¼ $\mu$m, as shown in Equation 7.

$$e_{1/4\mu m}(j) = round(e(j)\cdot 4)\frac{1/4\ \mu m}{\mu m} \qquad \text{Equation (7)}$$

Meanwhile, the discrete AC component, $e_{1/4}$ $\mu$m, can be converted to a discrete incremental AC count, $AC_{Error}$, as shown in Equation 8.

$$AC_{Error}(k)=e_{1/4\ \mu m}(k+1)-e_{1/4\ \mu m}(k)1\leqq k\leqq 2400 \qquad \text{Equation (8)}$$

According to one embodiment of the present invention, the DC component can be determined by identifying the variation of the average effective circumference of feed roller 36 from the nominal value of the circumference of the feed roller. For example, a discrete DC error, $DC_{Error}$, can be calculated as shown in Equation 9, where the difference is taken from a feed roller having a nominal circumference of 18.15 mm.

$$DC_{Error} = round\left(CircumferenceAverage\ (\text{mm}) - \pi\cdot 18.15\text{mm}\cdot\left(\frac{1/4\ \mu m}{4000\ mm}\right)\right) \qquad \text{Equation (9)}$$

In a preferred embodiment of the present invention, the relationship is stored in a manner that is accessible by media indexing system 12. For example, a relationship can be downloaded into memory, such as by downloading the error map into memory 90. According to a preferred embodiment of the present invention, for example, the AC and DC components of the error map can be downloaded into memory 90, such as a programmable memory device, for example. Preferably, the programmable memory device comprises an electrically erasable programmable read-only memory (EE-PROM) device. One advantage of placing memory 90 within a preferred media indexing system 12 can include allowing control module 58 the ability to rebuild the error map upon activation of the media indexing system 12, as can be understood by one of ordinary skill in the art.

In conventional systems utilizing feed rollers coupled to drive motors, a control system typically commands the shaft of the drive motor to move a constant angular rotation for a desired media displacement. Accordingly, if the shaft of a feed roller had a nominal diameter of 18.15 mm and the desired media move was 12.7 mm, then the desired angular movement would be 80.22 degrees or 534.82 lines, regardless of the angular position of the feed roller. According to a preferred embodiment of the present invention, a nonlinear and empirically determined relationship between rotation of feed roller 36 (e.g., by way of encoder disc 22) and displacement of print receiving medium 32 is determined. In the present illustrative embodiment, an error map is utilized so that the desired angular movement, $\delta\theta$, will change depending on the angular position of the feed roller 36.

Figure 12:
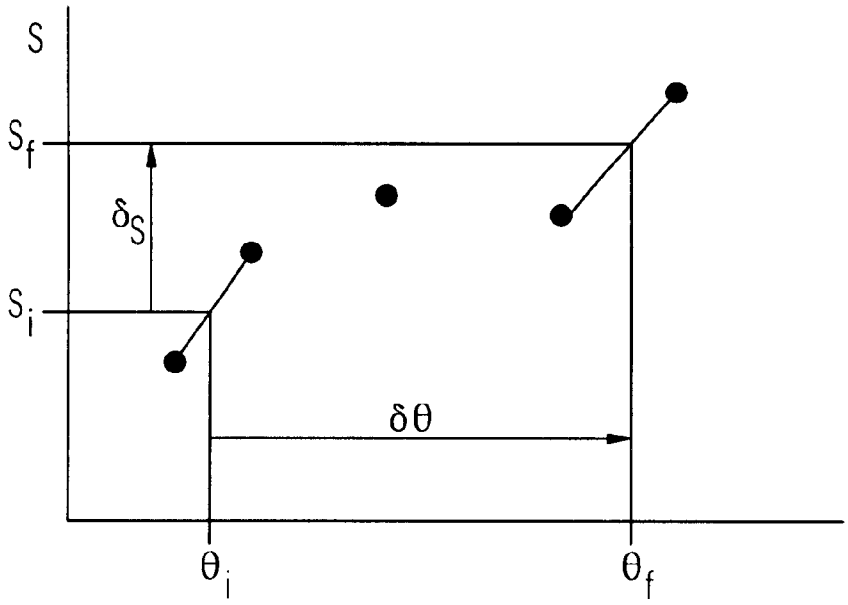
FIG. 12 is a graphical representation of the application of an error map according to one embodiment of the present invention.

As illustrated in FIG. 12, according to one embodiment of the present invention, the desired angular movement, $\delta\theta$, as utilized with the illustrative embodiment discussed above, can be determined through the following steps. For example, the initial angular position, $\theta_i$, can be determined (e.g., from the rotary encoder). The initial media position, $s_i$, can be determined from the initial angular position, $\theta_i$, such as through interpolation, for example. The final media position, $S_f$ can be calculated and used to determine the final angular position, $\theta_f$, such as through interpolation, for example. Given the initial and final angular positions, $\theta_i$ and $\theta_f$, respectively, the desired angular movement, $\delta\theta$ of feed roller 36 can be determined. Control module 58, can then send a command to rotate feed roller 36 by $\delta\theta$.

As a further detailed example, if the initial angular position, $\theta_i$, of feed roller 36 is 714.13 lines, and the desired media movement, $\delta$, is 12.7 mm, the initial media position, $s_i$, can be calculated by interpolating between points in the error map, s, as shown by example in Equation 10.

TABLE 1

Determining Initial Media Position

| θ | s |
|---|---|
| 714 | 16.9984 |
| 714.13 | $s_i$ |
| 715 | 17.0222 |

$$s_i = \frac{(17.0222-16.9984)}{(715-714)}(714.13-714)+16.9984 = 17.0015\ \text{mm} \qquad \text{Equation (10)}$$

The final media position, $s_f$, can then be calculated as shown in Equation 11.

$$s_f=s_i+\delta s=17.0015+12.7=29.7015\ \text{mm} \qquad \text{Equation (11)}$$

The final angular position, $\theta_f$, can then be determined as shown below in Equation 12.

TABLE 2

Determining Final Media Position

| θ | s |
|---|---|
| 1248 | 29.7006 |
| $\theta_f$ | 29.7015 |
| 1249 | 29.7243 |

$$\theta_f = \frac{(1249-1248)}{(29.7243-29.7006)}(29.7015-29.7006)+1248 = 1248.04\ \text{lines} \qquad \text{Equation (12)}$$

Finally, the desired angular movement of feed roller 36 can be determined as shown in Equation 13.

$$\delta\theta=\theta_f-\theta_i=1248.04-714.13=533.91\ \text{lines} \qquad \text{Equation (13)}$$

According to one embodiment of the present invention, a method and system for accurately indexing print receiving media of various types is provided. A print receiving medium of a particular type can be supplied to a media indexing system, such as media indexing system 12. The type of the print receiving medium can be identified.

For example, according to one embodiment of the present invention, a sensor 96 can be used to generally identify the type of print receiving medium being indexed. As can be understood by one of ordinary skill in the art, sensor 96 can comprise, for example, an optical sensor capable of automatically determining a type of print receiving medium. Alternatively, the media type may be selected manually, as with a set of commands or switches, for example, that can be controlled by a user of media indexing system 12.

A desired amount by which the print receiving medium should be indexed is identified. A commanded indexing operation of media indexing system 12, such as one comprising feed roller 36, is modified based on the type of print receiving medium and a relationship between the commanded indexing operation and a resultant indexing of a first type of print receiving medium. For example, the commanded indexing operation can be scaled based on the type of print receiving medium being indexed. According to a preferred embodiment of the present invention, the commanded indexing operation can be scaled based on a proportionality of an effective circumference of a roller, such as feed roller 36, when indexing a print receiving medium of a first type, to an effective circumference of the roller when indexing a print receiving medium of the type being indexed. Preferably, a control module, such as control module 58, is utilized to identify the desired amount of the indexing move and to modify the commanded indexing operation.

Preferably, the desired amount by which print receiving medium should be indexed is scaled based on the type of print receiving medium being indexed and an error map, based on the relationship, is applied to the scaled desired amount. According an alternative embodiment, at least a portion of the error map is scaled and the scaled error map is applied to the desired amount by which print receiving medium should be indexed.

According to a preferred embodiment of the present invention, the relationship is determined by supplying a print receiving medium of a first type to media indexing system 12. The media indexing system 12 can be operated to index the print receiving medium of the first type. An amount by which, for example, feed roller 36 has been indexed during operation of the media indexing system 12 can be determined.

Meanwhile, an amount by which the print receiving medium of the first type has been indexed in response to the amount by which feed roller 36 has been indexed can be determined. The amount by feed roller 36 has been indexed can be correlated to the amount by which the print receiving medium of the first type has been indexed to define the relationship. For example, in a preferred embodiment, a difference between a change in angular position of feed roller 36 and a resultant change in index position of the print receiving medium of the first type can be determined.

In a preferred embodiment of the present invention, the error map is separated into AC and DC components, wherein the AC component comprises the variation of the mapped differences from a line defined by an average effective circumference of the roller as seen by the print receiving medium of the first type. Meanwhile, the DC component preferably comprises the variation of the average effective circumference of the roller from a nominal value of the circumference of the roller. According to one embodiment of the present invention, the DC component can be scaled by a ratio of an average effective circumference of rollers as seen by print receiving media of the type being indexed to an average effective circumference of the rollers as seen by the print receiving media of the first type. After scaling the DC component of the error map, the error map with the scaled DC component can be applied to the desired amount by which the print receiving medium should be indexed to modify the commanded indexing operation of the roller.

Preferably, the desired amount by which the print receiving medium should be indexed is scaled by a ratio of an average effective circumference of rollers as seen by print receiving media of the type being indexed to an average effective circumference of the rollers as seen by the print receiving media of the first type. According to such an embodiment, the error map can be applied to the scaled desired amount by which the print receiving medium should be indexed to modify the commanded indexing operation of the roller. One advantage of a method and system according to this embodiment of the present invention can be that print receiving medium 32 can be indexed by substantially the desired amount, thereby helping to avoid problems associated with, for example, swath misplacement. A preferred form of an embodiment of the present invention is further described in more detail below.

An error map can change depending on the media being indexed through the system. In a preferred embodiment of the illustrative example, media indexing system 12 is error mapped with a single type of media, and the error map is scaled for different types of media being indexed.

Figure 13:
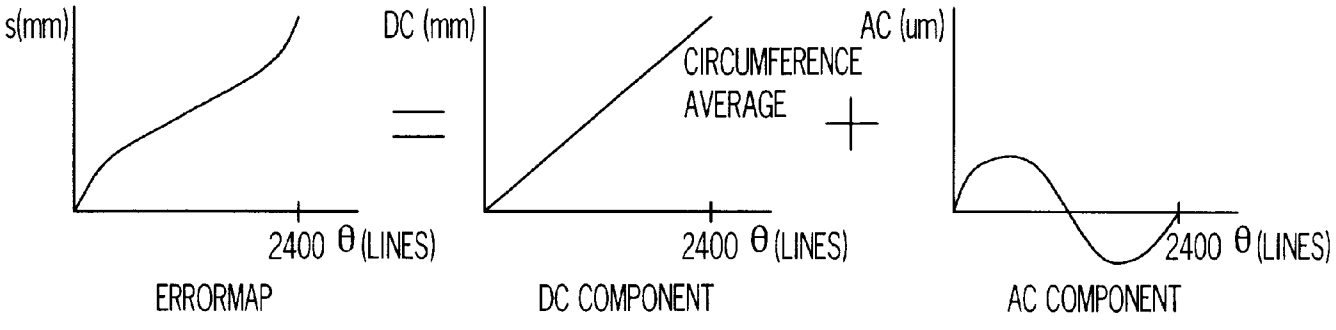
FIG. 13 is a graphical representation of the AC and DC components of an exemplary error map according to one embodiment of the present invention.

For example and as alluded to previously and shown in FIG. 13, the error map can be spilt into two components: DC and AC. The DC component can represent a line with a slope defined by the effective circumference of feed roller 36 as seen by the respective media. The AC component can be defined by the error vector, e. Preferably, the error vector corresponds to the oscillation of the error map about the line defined by the average effective circumference of feed roller 36.

$$\text{DC Component} = \frac{CircumferenceAverage}{2400\ \text{lines}} = \frac{s(2401)\ \text{mm}}{2400\ \text{lines}} \qquad \text{Equation (14)}$$

$$\text{AC Component} = e(j) = \left[\left(\frac{CircumferenceAverage}{2400\ \text{lines}} \cdot \theta - s(j)\right) \cdot 1000\right] \mu\text{m} \qquad \text{(Equation (15)}$$

Preferably, the roller comprises a discrete number of angular positions. According to such an embodiment, differences between angular position of the roller and index positions of the print receiving medium of the first type can be mapped for each of the discrete number of angular positions to define the relationship. Preferably, the mapped differences are stored as an error map.

According to one embodiment of the present invention, media indexing system 12, such as one used with printer 30, can be error mapped using typical office media, such as standard 20# paper. The AC and DC components of the error map can be determined. A set of statistically determined scale factors for various media can also be programmed into, for example, the control module 58. These scale factors can be used to scale, for example, the DC component of the error map, and allow one error map to be used to modify the commanded indexing operation. Table 3 shows various media scale factors determined according to one embodiment of the present invention.

TABLE 3

Media Circumference Variation

| Media | 20# | Transparency | Coated | Photo | 90# | 16# |
|---|---|---|---|---|---|---|
| Circumference1 (mm) | 57.1189 | 57.0858 | 57.1293 | 57.1162 | 57.1400 | 57.0832 |
| Circumference2 (mm) | 57.1271 | 57.0819 | 57.1341 | 57.1201 | 57.1418 | 57.0956 |
| Circumference3 (mm) | 57.1271 | 57.0843 | 57.1329 | 57.1224 | 57.1347 | 57.0846 |
| Average (mm) | 57.1244 | 57.0840 | 57.1321 | 57.1196 | 57.1388 | 57.0878 |
| Scale | 1.00000 | 0.99929 | 1.00014 | 0.99992 | 1.00025 | 0.99936 |

The DC component of an error map is believed to vary with different media types, while the AC component is believed to remain approximately the same. For example, the DC component is believed to change due to, for example, the variation between media in thickness, mass, and coefficient of friction. These variations are believed to result in, for example, a different amount of slippage between feed roller 36 and the media being indexed. This varying slippage is believed to result in a different effective circumference of feed roller 36 as seen by the media.

According to one embodiment of the present invention, an error map can be scaled through circumference scaling. For example, as seen in Equation 16, the scale factor, $\alpha$, can be defined as the ratio between effective circumferences as seen by different types of media. For example, the scale factor can be set relative to 20# paper.

$$\alpha = \frac{MediaCircumference}{20\#Circumference} \quad \text{Equation (16)}$$

According to one illustrative embodiment, if an error map generated with 20# paper needed to be scaled to index transparencies, the new error map, s3', can be determined by multiplying the cumulative counts by the ratio of the circumferences, as shown in Equation 17.

$$s3' = \frac{s2}{57.1244} \cdot 57.0840 = 0.99929 \cdot s2 \quad \text{Equation (17)}$$

$$\alpha = 0.99929$$

According to a preferred embodiment of the present invention, desired media move scaling is utilized. For example, the desired media move, $\delta s$, can be scaled instead of the entire error map, s. According to such an embodiment, the scaled desired media move, $\delta s_{SCALE}$, can be adjusted with the same scale factor, $\alpha$, as shown in Equation 18.

$$\delta s_{SCALE} = \frac{\delta s}{\alpha} \quad \text{Equation (18)}$$

Figure 14:
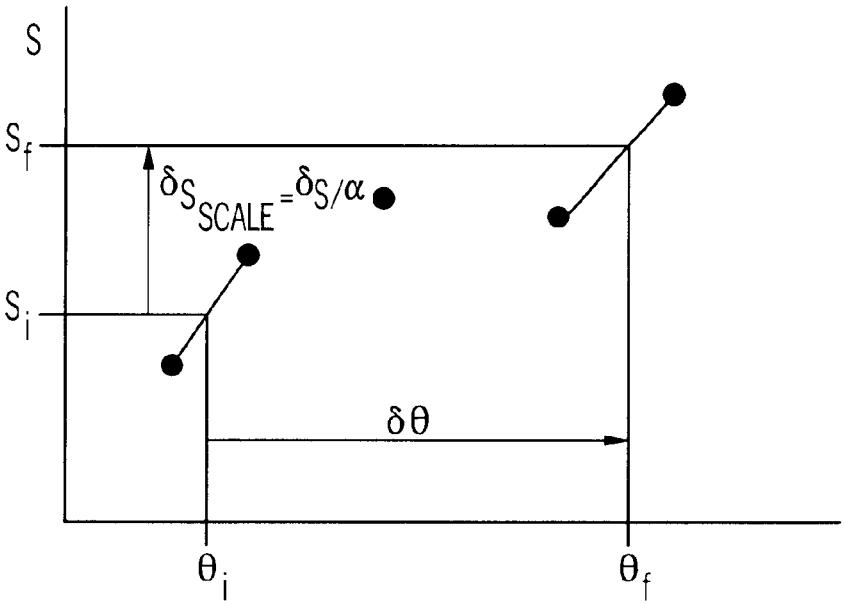
FIG. 14 is a graphical representation of the application of an error map with scaling as utilized in a preferred embodiment of the present invention.

FIG. 14 shows, by illustration, how the scaled desired media move, $\delta s_{SCALE}$, might be used with the exemplary 20# paper error map. For example, if the 20# paper error map was used to index a transparency 12.7 mm, the desired media move, $\delta s_{SCALE}$, would be 12.709 mm. Accordingly, this preferred method can use the error map to calculate the desired angular rotation, $\delta\theta$, to index 20# paper 12.709 mm, while, in reality, media indexing system 12 would index a transparency substantially 12.7 mm.

Implementing the error map can be labor intensive for the control module 58. For example, creating a cumulative table of media displacement is believed to make the numbers to large in magnitude for interpolation, calculation, and storage to be done efficiently. In particular, performing interpolation is believed to increase the time needed to calculate the desired angular movement, $\delta\theta$, and thereby decreases the cycle time of media indexing system 12, such as one used in printer 30.

Preferably, control module 58 uses an error table that shows the difference in actual media displacement compared to an ideal feed roller (e.g., one with an 18.15 mm diameter). This preferred algorithm assumes that the distance between points in the total error, $e_{TOTAL}$, is small enough not to interpolate.

Figure 15:
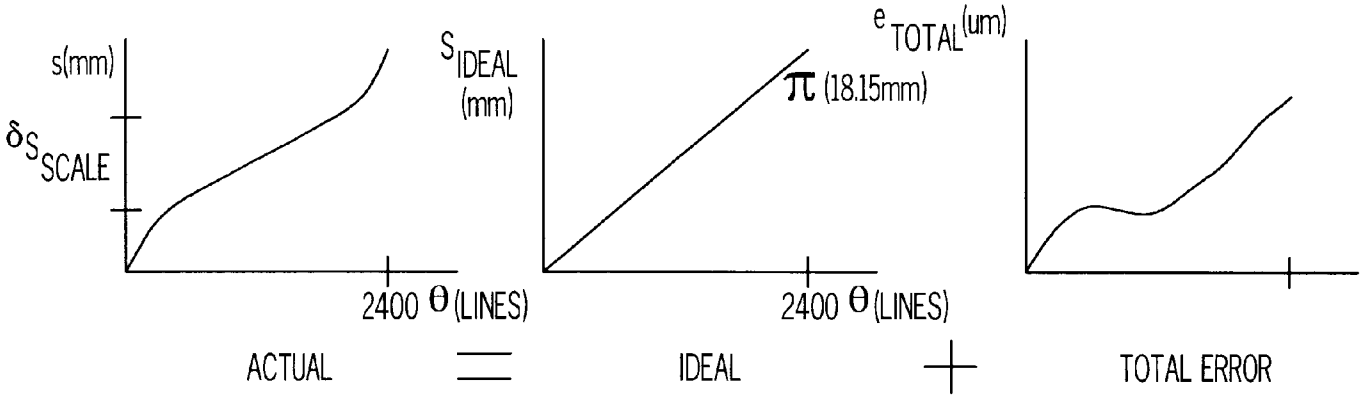
FIG. 15 is a graphical representation of an exemplary error map, ideal feed roller, and total error according to one embodiment of the present invention.

For example, FIG. 15 shows an error map, s, split into ideal displacement, $s_{IDEAL}$, and total error, $e_{TOTAL}$. The media displacement, $s_{IDEAL}$, of an ideal 18.15 mm diameter feed roller is shown in Equation 19. Moreover, $e_{TOTAL}$ can represent the difference between actual displacement, s, of feed roller 36 and the ideal displacement, $s_{IDEAL}$, as shown in Equation 20.

$$s_{IDEAL}(\theta) = \frac{\pi D}{2400}\theta \quad \text{Equation (19)}$$

$$D = 18.15 \text{ mm}$$

$$e_{TOTAL}(\theta) = (s(\theta) - s_{IDEAL}(\theta)) \cdot \left(\frac{1000\ \mu m}{1\ mm}\right) \quad \text{Equation (20)}$$

Figure 16:
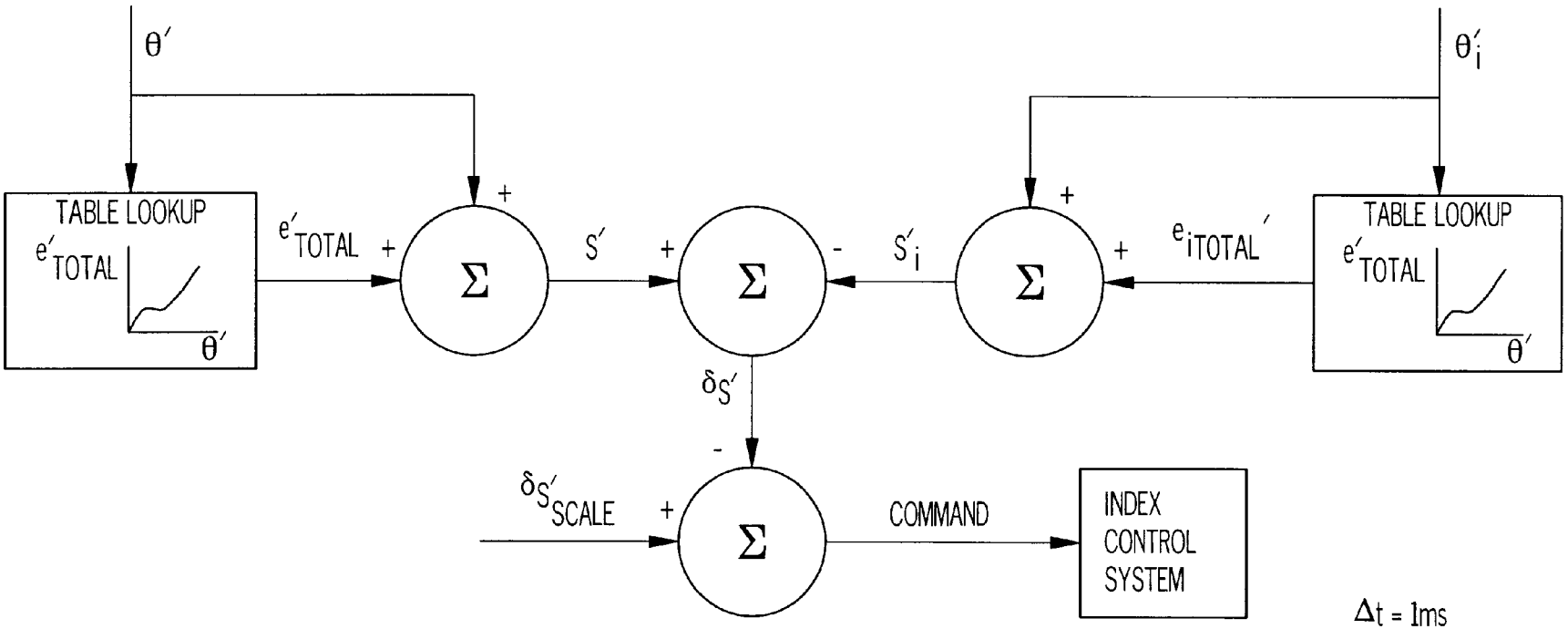
FIG. 16 is a control block diagram as utilized by a preferred embodiment of the present invention.

FIG. 16 shows a preferred control block diagram for calculating the control system command (in index system coordinates). The angular position, $\theta'$, can be acquired. A table lookup can round down to determine the total error, $e'_{TOTAL}$. The current position, s', can be determined by adding the current angular position, $\theta'$, and the total error, $e'_{TOTAL}$. The initial position, $s'_i$, can be subtracted from the current position, s', to determine how far the media has moved. The current move distance, $\delta s'$, can be subtracted from the scaled desired move distance, $\delta s'_{SCALE}$, to determine the total distance left in the index move, wherein the total distance left to travel can represent the command sent to the index control module 58.

The foregoing description of the preferred embodiments of the present invention has been presented for purposes of illustration and description. It is not intended to be exhaustive or to limit the invention to the precise form disclosed, and modifications and variations are possible in light of the above teachings. For example, although a number of materials and components have been described or shown for use in the preferred embodiments of the present invention, it is to be understood that other materials and components could be used as alternatives to those described or shown without departing from the scope of the invention.

Thus, it should be understood that the embodiments were (chosen and described in order to best illustrate the principals of the invention and its practical application. This illustration was provided to thereby enable one of ordinary skill in the art to best utilize the invention in various embodiments and with various modifications as are suited for the particular use contemplated. Accordingly, it is intended that the scope of the invention be defined by the claims appended hereto.

We claim:

1. A method for determining a relationship between a commanded indexing operation of a roller in a media indexing system and resultant indexing of a first type of print receiving medium, comprising the steps of:

a) supplying a print receiving medium of the first type to the media indexing system;

b) operating the media indexing system to index the print receiving medium of the first type;

c) determining an amount by which the roller has been indexed during operation of the media indexing system;

d) determining an amount by which the print receiving medium of the first type has been indexed in response to the amount by which the roller has been indexed;

e) correlating the amount by which the roller has been indexed to the amount by which the print receiving medium of the first type has been indexed to define the relationship; and f) storing the relationship.

2. A method for accurately indexing print receiving media of various types, comprising the steps of:

a) providing a media indexing system comprising a roller capable of indexing a print receiving medium in response to an indexing operation, wherein a relationship exists between a commanded indexing operation of the roller and resultant indexing of a first type of print receiving medium;

b) supplying a print receiving medium having a type to the media indexing system;

c) generally identifying the type of the print receiving medium;

d) identifying a desired amount by which the print receiving medium should be indexed; and c) modifying a commanded indexing operation of the roller to index by the desired amount based on the type of the print receiving medium and said relationship, wherein the print receiving medium is indexed by substantially the desired amount, wherein said step of modifying a commanded indexing operation comprises scaling the commanded indexing operation of the roller based on the type of the print receiving medium, and wherein said step of scaling the commanded indexing operation comprises scaling the commanded indexing operation based on a proportionality of an effective circumference of the roller when indexing a print receiving medium of the first type to an effective circumference of the roller when indexing a print receiving medium of the type being indexed.

3. A method according to claim 2, wherein said step of generally identifying the type of the print receiving medium comprises manually selecting the type of the print receiving medium.

4. A method according to claim 2, wherein said step of generally identifying the type of the print receiving medium comprises automatically determining the type of the print receiving medium.

5. A method according to claim 2, wherein said modifying step further comprises modifying the commanded indexing operation based on the position of the roller.

6. A method for accurately indexing print receiving media of various types, comprising the steps of:

a) providing a media indexing system comprising a roller capable of indexing a print receiving medium in response to an indexing operation, wherein a relationship exists between a commanded indexing operation of the roller and resultant indexing of a first type of print receiving medium;

b) supplying a print receiving medium having a type to the media indexing system;

c) generally identifying the type of the print receiving medium;

d) identifying a desired amount by which the print receiving medium should be indexed; and e) modifying a commanded indexing operation of the roller to index by the desired amount based on the type of the print receiving medium and said relationship, wherein the print receiving medium is indexed by substantially the desired amount, wherein said step modifying a commanded indexing operation comprises scaling the desired amount by which the print receiving medium should be indexed based on the type of the print receiving medium and applying an error map, based on said relationship, to the scaled desired amount.

7. A method for accurately indexing print receiving media of various types, comprising the steps of:

a) providing a media indexing system comprising a roller capable of indexing a print receiving medium in response to an indexing operation, wherein relationship exists between a commanded indexing operation of the roller and resultant indexing of a first type of print receiving medium;

b) supplying a print receiving medium having a type to the media indexing system;

c) generally identifying the type of the print receiving medium;

d) identifying a desired amount by which the print receiving medium should be indexed; and c) modifying, a commanded indexing operation of the roller to index by the desired amount based on the type of the print receiving medium and said relationship, wherein the print receiving medium is indexed by substantially the desired amount, wherein said step of modifying a commanded indexing operation comprises scaling at least a portion of an error map based on the type of the print receiving medium and applying the scaled error map to the desired amount by which the print receiving medium should be indexed, wherein the error map is based on said relationship.

8. A method for accurately indexing print receiving media of various types in a printer, comprising the steps of:

a) providing a media indexing system comprising a roller capable of indexing a print receiving medium in response to an indexing operation, wherein a relationship exists between a commanded indexing operation of the roller and resultant indexing of a first type of print receiving medium;

b) supplying a print receiving medium of the first type to the media indexing system;

c) operating the media indexing system to index the print receiving medium of the first type;

d) determining an amount by which the roller has been indexed during operation of the media indexing system;

e) determining an amount by which the print receiving medium of the first type has been indexed in response to the amount by which the roller has been indexed;

f) correlating the amount by which the roller has been indexed to the amount by which the print receiving medium of the first type has been indexed to define the relationship;

g) storing the relationship;

h) supplying a print receiving medium having a type to the media indexing system;

i) generally identifying the type of the print receiving medium;

j) identifying a desired amount by which the print receiving medium should be indexed; and k) modifying a commanded indexing operation of the roller to index by the desired amount based on the type of the print receiving medium and said relationship, wherein the print receiving medium is indexed by substantially the desired amount.

9. A method according to claims 8, wherein said step of determining an amount by which the print receiving medium of the first type has been indexed comprises detecting positions on a linear encoder strip coupled to the print receiving medium of the first type to track index positions of the print receiving medium of the first type.

10. A method according to claim 9, wherein said step of detecting positions on a linear encoder strip comprises:

a) counting the positions on the linear encoder strip in quadrature; and b) interpolating between said quadrature counts of the positions on the linear encoder strip to track the index positions of the print receiving medium of the first type.

11. A method according to claim 8, wherein said determining steps and said correlating step comprise determining a difference between a change in angular position of the roller and a resultant change in index position of the print receiving medium of the first type.

12. A method according to claim 11, wherein said step of determining an amount by which the roller has been indexed comprises detecting positions on an encoder disk directly coupled to the roller to track angular positions of the roller.

13. A method according to claim 12, wherein said step of detecting positions on an encoder disk comprises:

a) counting the angular positions of the roller in quadrature; and b) interpolating between said quadrature counts of the angular positions to track the angular positions.

14. A method according to claim 11, wherein said step of determining a difference between a change in angular position of the roller and a resultant change in index position of the print receiving medium of the first type further comprises determining the difference while rotating the roller at a constant velocity.

15. A method according to claim 14, further comprising determining the repeatability of the difference over a plurality of revolutions of the roller.

16. A method according to claim 14, further comprising the step of filtering noise from the relationship, comprising the steps of:

a) converting a count of the index positions of the print receiving medium of the first type during each revolution to a cumulative count; and b) averaging the cumulative count.

17. A method according to claim 11, wherein the roller comprises a discrete number of angular positions, further comprising the step of mapping differences between angular position of the roller and index positions of the print receiving medium of the first type for each of the discrete number of angular positions to define the relationship.

18. A method according to claim 17, wherein said step of storing the relationship comprises storing said mapped differences as an error map.

19. A method according to claim 18, wherein said step of modifying a commanded indexing operation of the roller comprises:

a) scaling the desired amount by which the print receiving medium should be indexed by a ratio of an average effective circumference of rollers as seen by print receiving media of the type being indexed to an average effective circumference of the rollers as seen by print receiving media of the first type; and b) applying the error map to the scaled desired amount by which the print receiving medium should be indexed to modify the commanded indexing operation of the roller.

20. A method according to claim 18, further comprising separating said error map into an AC component and a DC component, the AC component comprising the variation of the mapped differences from a line defined by an average effective circumference of the roller as seen by the print receiving medium of the first type and the DC component comprising the variation of the average effective circumference of the roller from a nominal value of the circumference of the roller.

21. A method according to claim 20, wherein said step of modifying a commanded indexing operation of the roller comprises:

a) scaling the DC component by a ratio of an average effective circumference of rollers as seen by print receiving media of the type being indexed to an average effective circumference of the rollers as seen by print receiving media of the first type; and b) after scaling the DC component of the error map, applying the error map with the scaled DC component to the desired amount by which the print receiving medium should be indexed to modify the commanded indexing operation of the roller.

* * * * *

UNITED STATES PATENT AND TRADEMARK OFFICE

CERTIFICATE OF CORRECTION

PATENT NO. : 6,428,224
DATED : August 6, 2000
INVENTOR(S) : Benjamin Alan Askren et al.

It is certified that error appears in the above-identified patent and that said Letters Patent is hereby corrected as shown below:

Column 18,
Line 23, after “wherein said step” insert -- of --.
Line 33, after “wherein” insert -- a --.
Line 43, after “modifying” delete “,”.

Column 19,
Line 23, replace “claims” with -- claim --.

Signed and Sealed this

Twenty-sixth Day of November, 2002

*Attest:*

*Attesting Officer*

JAMES E. ROGAN
*Director of the United States Patent and Trademark Office*